US008353567B1

(12) United States Patent
Banerjee et al.

(10) Patent No.: US 8,353,567 B1
(45) Date of Patent: Jan. 15, 2013

(54) DRIVE WAVEFORM GENERATION

(75) Inventors: Neel Banerjee, Corvallis, OR (US); Andrew L. Van Brocklin, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 254 days.

(21) Appl. No.: 12/877,239

(22) Filed: Sep. 8, 2010

(51) Int. Cl.
*B41J 29/38* (2006.01)

(52) U.S. Cl. ..... 347/10

(58) Field of Classification Search ..... 347/9–11
See application file for complete search history.

(56) References Cited

U.S. PATENT DOCUMENTS 6,705,696 B1 * 3/2004 Okuda et al. ..... 347/11

FOREIGN PATENT DOCUMENTS

WO 2009/080684 A1 7/2009

* cited by examiner

*Primary Examiner* — An Do

(57) ABSTRACT

In one embodiment, a drive waveform generator to control ejection of liquid from a set of ejection elements in single-pass printing. A first waveform source defines a first aspect of a drive waveform for the set of ejection elements and for other ejection elements. A second waveform source defines a second aspect of the drive waveform for the set of ejection elements but not for the other ejection elements. A circuit uses the first waveform source and the second waveform source to generate the drive waveform having the first and second aspects.

20 Claims, 9 Drawing Sheets

DRIVE WAVEFORM GENERATION

BACKGROUND

The desire to improve the image quality of printed output produced by inkjet printing systems has led to the development of printheads with increased densities of liquid ejection elements, typically characterized in nozzles-per-inch. These liquid ejection elements controllably emit a number of drops of a given color liquid onto a particular location of a print medium that corresponds to a particular portion, such as a pixel, of an image being printed. Along with the desire for improved image quality often comes the desire for higher printing throughput, in order to reduce the time needed to produce the printed output. One technique for increasing throughput is to deposit all of the drops of the given color liquid on the particular location from a single liquid ejection element in a single printing pass of the ejection element and the print medium relative to each other.

However, difficulties in fabricating printheads with high ejection element densities may lead to low manufacturing yields for printheads capable of producing the high image quality desired. In turn, this low yield results in high printhead costs and prices. In addition, over time the printing characteristics of some of the ejection elements may degrade with usage. If the degradation in image quality reaches an unacceptable level, printhead replacement is performed, at additional cost and effort to the user.

DETAILED DESCRIPTION

Figure 1:
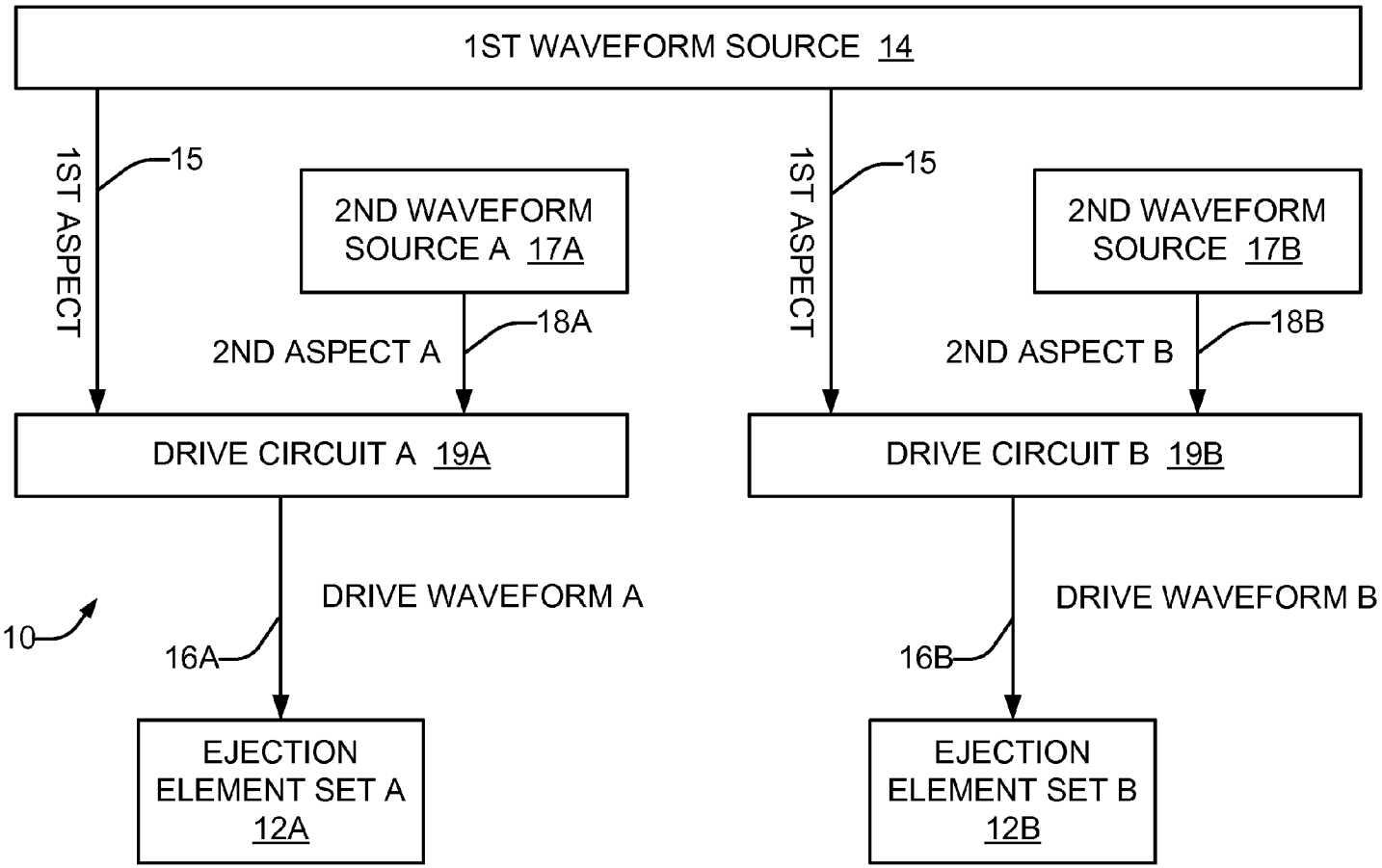
FIG. 1 is a schematic representation of an example drive waveform generator according to an embodiment of the present disclosure.

Referring now to the drawings, there is illustrated an embodiment of a drive waveform generator to control ejection of liquid from a set of ejection elements in a printhead. As defined herein and in the appended claims, a "liquid" shall be broadly understood to mean a fluid not composed primarily of a gas or gases.

One type of printhead in which the embodiment can be advantageously employed is a piezo-electric ("piezo") inkjet printhead. Such a printhead may be advantageously employed in a variety of printing devices ranging from large to small, including commercial printing systems, large-format printing systems, copiers, home and small office printers, all-in-one devices (e.g. a combination of at least two of a printer, scanner, copier, and fax), and numerous appliances which produce printed output, to name a few.

In a piezo printhead, the application of an electrical signal causes the piezo-electric material to displace or deform to generate pressure waves. The various chambers and other micro-electro-mechanical (MEMS) components of the printhead are constructed such that liquid supplied to a particular ejection element of the printhead can be controllably emitted or ejected from the printhead through a nozzle of the ejection element in response to the application, to the piezo material of the element, of an appropriate electrical signal at an appropriate time. The electrical signal is intended to eject a given volume (or "drop weight") of liquid, at a given velocity, in a given direction. However, it can be difficult to fabricate a piezo printhead in which all or most of the ejection elements eject liquid in an identical way in response to a particular electrical drive signal. For example, drop ejection characteristics such as the drop weight, drop velocity, and/or drop direction may vary from element to element. Furthermore, the various ejection elements may wear or degrade with usage or over time, one element often doing so differently from other elements. These effects can cause low yield during manufacturing, high cost, and premature wear-out. While multi-pass printing may mitigate degradation in image quality of the printed output by compensating for one element using another element, this reduces printing throughput, and such techniques are of little or no use in single-pass printing.

It is advantageous to have the capability to provide a different drive waveform to different ejection elements, in order to compensate for these manufacturing and wear deviations among the ejection elements. This compensation operation is also referred to as "trimming". However, particularly in piezo printheads having a relatively large number of densely-spaced ejection elements, it may be difficult and cost-prohibitive to provide a different drive waveform to each different ejection element. As a result, typically the same drive waveform is provided to many different ejection elements. Piezo printheads with a relatively small number of ejection elements or widely-spaced ejection elements may utilize multiple arbitrary high voltage waveform generators to provide a different drive waveform to different ejection elements. However, the circuitry for each of these waveform generators occupies a relatively large area and is relatively expensive to provide. Thus different drive waveforms for different densely-spaced ejection elements of a piezo printhead cannot be provided in a cost-effective or compact manner via multiple arbitrary high voltage waveform generators.

Embodiments of the present disclosure provide a different drive waveform to different ejection elements, in order to compensate for these manufacturing and wear deviations among the ejection elements, in a different manner. Employing these embodiments, liquid can be ejected from many or all of the ejection elements with substantially the same drop weight, velocity, and direction. As a result, high image quality output can be produced, and this production can be maintained over time, in single-pass printing using piezo printheads. To this end, in some embodiments, a compensation operation may be performed as part of the manufacturing process, periodically or as-needed during the life of the printhead, or in combination.

Considering now one embodiment of a drive waveform generator 10 to control ejection of liquid from a set 12A of ejection elements in single-pass printing, and with further reference to FIG. 1, a first waveform source 14 defines a first aspect 15 of a drive waveform 16A for the set 12A of ejection elements and for other ejection elements such as, for example, the ejection elements of set 12B. A second waveform source 17A defines a second aspect 18A of the drive waveform 16A for the set 12A of ejection elements, but not for the other ejection elements such as, for example, the ejection elements of set 12B. A circuit 19A uses the first waveform source 14 and the second waveform source 17A to generate the drive waveform 16A having the first 15 and second 18A aspects. By choosing appropriate characteristics or parameters for the first 15 and second 18A aspects, the drop weight, velocity, and direction of drops of liquid ejected from the elements of set 12A can be made consistent with those from other elements, such as the elements of set 12B. In some embodiments, the sets 12A and 12B of elements may each comprise a single ejection element. In some embodiments, each ejection element may constitute a different single-element set. Similarly, another circuit 19B uses the first waveform source 14 and the second waveform source 17B to generate the drive waveform 16B having the first 15 and second 18B aspects.

In one embodiment, the first 15 and second 18A,B aspects comprise respective first and second portions of the drive waveform 16A,B. The first and second portions, as will be discussed subsequently with reference to FIGS. 6 and 8, may be different pulses of the drive waveform 16. In these embodiments, as will be discussed subsequently with reference to FIGS. 2 and 3, the first waveform source 14 comprises a first waveform circuit, in one embodiment external waveform generator 232, to generate the first portion of the drive waveform 16; and each second waveform source 17A,B comprises a second waveform circuit, in one embodiment drive circuit 310, to generate the second portion of the drive waveform 16. Also as will be discussed subsequently with reference to FIG. 6, each circuit 19A,B comprises a switch to selectably apply the first portion or the second portion of the drive waveform 16 to an individual one of the set 12A,B of ejection elements.

In another embodiment, the first 15 and second 18 aspects comprise first and second parameters of the drive waveform 16 respectively. In these embodiments, as will be discussed subsequently with reference to FIGS. 3 and 4, the first waveform source 14 comprises at least one global data register, in one embodiment global data registers 330, to define the first parameter of the drive waveform 16, and each second waveform source 18A,B comprises at least one local data register, in one embodiment local data registers 340, to define the second parameter of the drive waveform 16. Also as will be discussed subsequently with reference to FIG. 5, each circuit 19A,B comprises a digital generator, in one embodiment digital waveform generator 520, coupled to the global and local data registers to generate digital data corresponding to the first and second parameters, and a high voltage level shifter, in one embodiment high voltage level shifter 610, that receives the digital data and generates the drive waveform 16 for an individual one of the set 12A,B of ejection elements.

Figure 2:
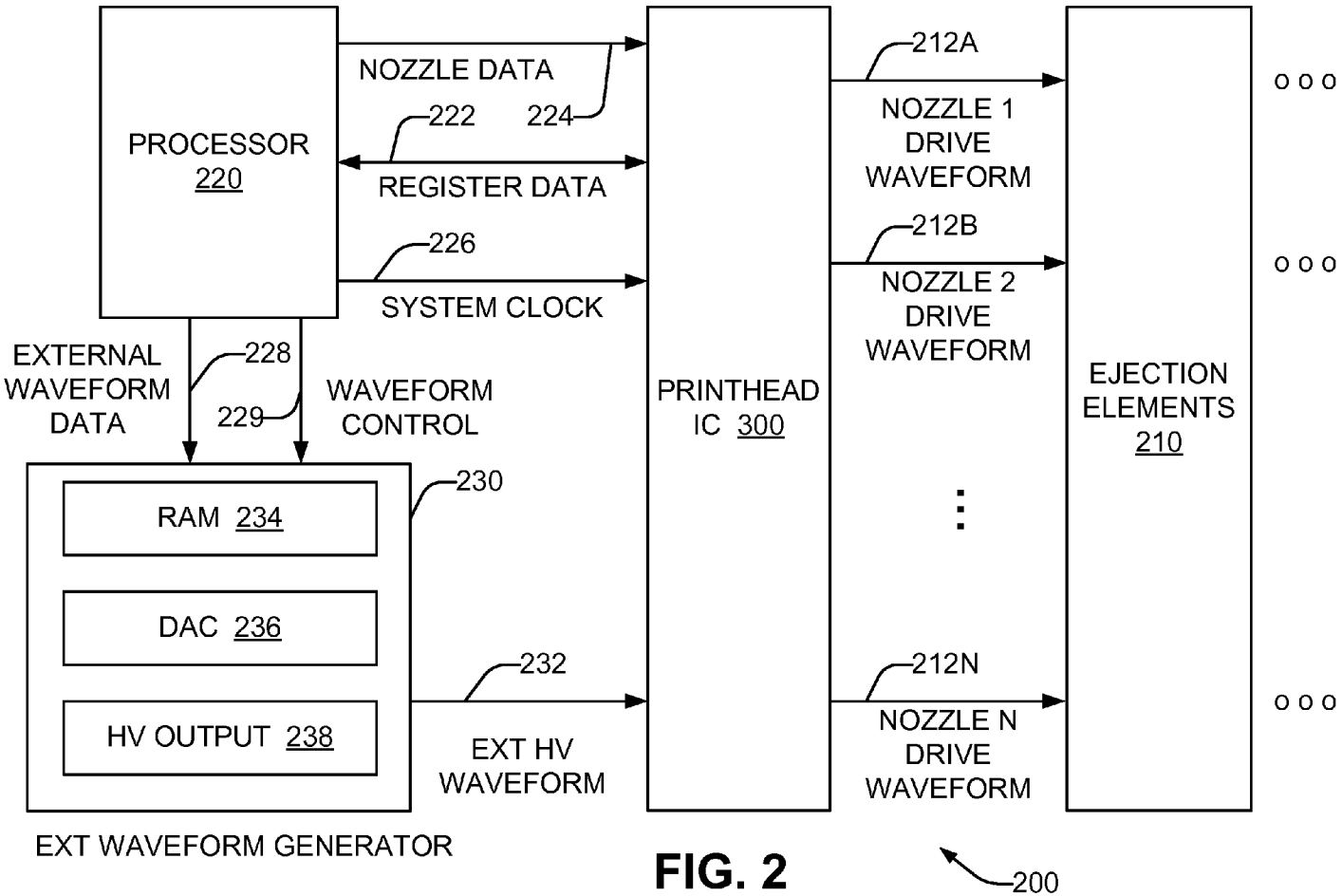
FIG. 2 is a schematic representation of a printhead according to an embodiment of the present disclosure that utilizes the drive waveform generator of FIG. 1.

Considering now one embodiment of a printhead for controllably ejecting liquid in single-pass printing, and with further reference to FIG. 2, a printhead 200 includes a plurality of ejection elements 210. The ejection elements 210 in some embodiments may be inkjet-type ejection elements generally, and piezo-electric inkjet-type ejection elements more specifically. The ejection elements may be arranged as a substantially linear array comprising, in some embodiments, hundreds to thousands of elements. The nozzles of the ejection elements through which the liquid is ejected may be disposed at a density that may range, in some embodiments, from 300 nozzles per inch (npi) to 1200 npi or greater. Nozzle drive waveforms are supplied to the ejection elements 210 via lines 212A,B,N. Each individual one of the ejection elements 210 is driven by a corresponding individual one of the drive waveforms. As has been described previously, the ejection elements 210 may be divided into subsets, such as sets 12A,B. As will be described subsequently in greater detail with reference to FIG. 8, a drive waveform for a piezo ejection element typically comprises a sequence of bipolar high-voltage pulses that causes a desired number of drops to be controllably ejected from the nozzle of the ejection element.

Figure 3:
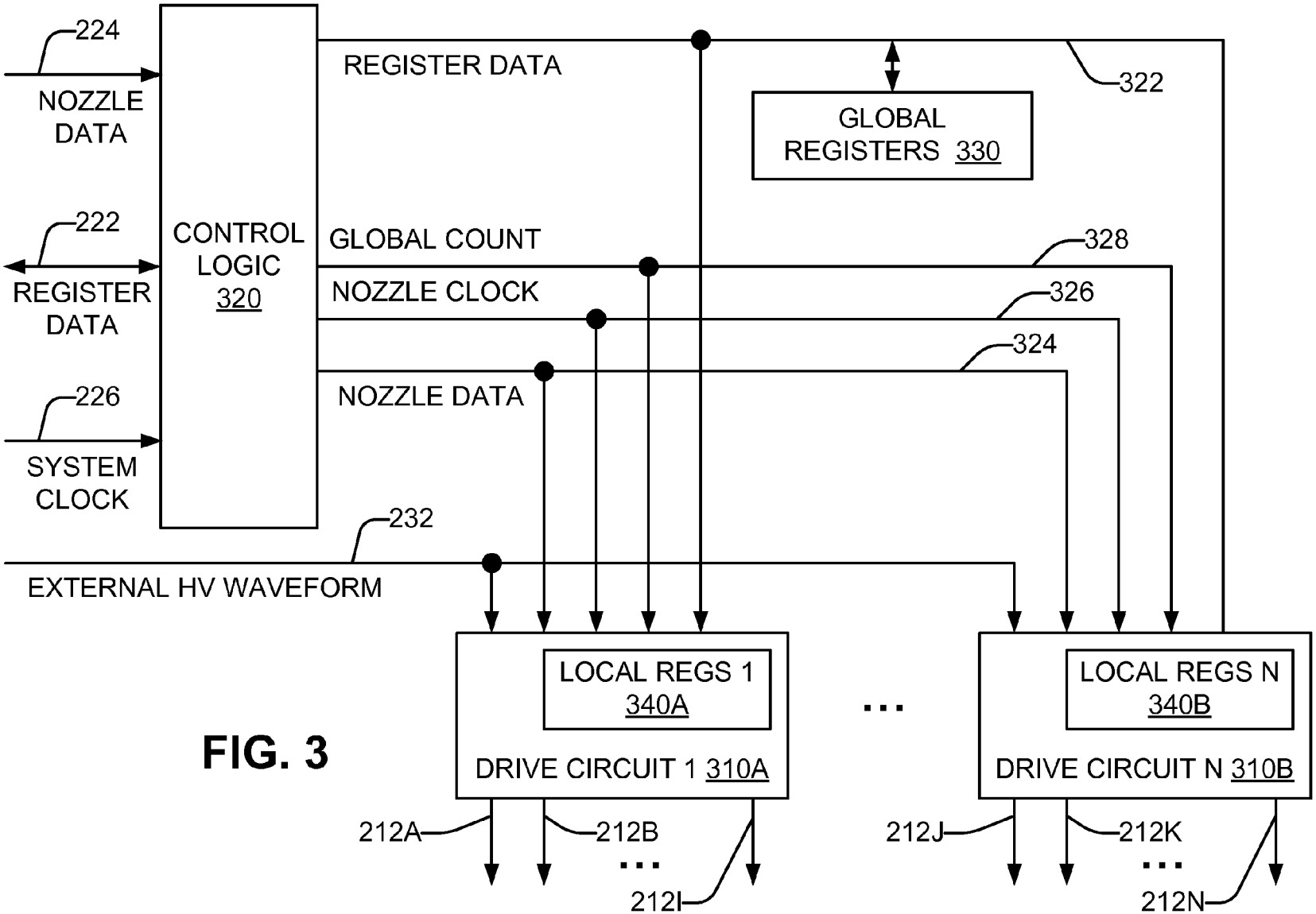
FIG. 3 is a schematic representation of a printhead IC according to an embodiment of the present disclosure usable with the printhead of FIG. 2.

A printhead IC (integrated circuit) 300, which will be discussed subsequently in greater detail with reference to FIG. 3, provides the drive waveforms to the ejection elements 210. The printhead IC 300 receives, from a processor 220, register data 222, nozzle data 224, and a system clock 226. In some embodiments the processor 220 may be, for example, a microprocessor, a microcontroller, or the like. The system clock 226 synchronizes operation of the various components of the printhead 200. The register data 222 comprises parametric data that collectively defines, in part, the various drive waveforms. The nozzle data 224 specifies the desired number of drops to be controllably ejected from the individual nozzles of the ejection elements at various times and onto various locations of the print medium to form the desired printed output. The number of drops to be ejected from an individual nozzle also defines, in part, the drive waveform for that nozzle. How the register data 222 and the nozzle data 224 define a drive waveform will be subsequently discussed in greater detail with reference to FIGS. 7 and 8. The register data 222 may be communicated between the processor 220 and the printhead IC 300 via a register data bus having data and clock lines and operating according to an appropriate data transfer protocol. Similarly, the nozzle data 224 may also be communicated between the processor 220 and the printhead IC 300 via a nozzle data bus having data and clock lines and operating according to an appropriate data transfer protocol.

The processor 220 also supplies external waveform data 228 to an external waveform generator 230 that uses the data 228 to generate a corresponding external high voltage waveform signal 232 that is provided to the printhead IC 300. In one embodiment of the external waveform generator 230, the data 228 is stored in a memory, such as RAM 234, of the external waveform generator 230 and supplied to a digital-to-analog converter (DAC) 236 to generate an arbitrary waveform signal in conformance with the data 228. The arbitrary waveform signal is in turn provided to a high voltage output circuit 238 that generates the external high voltage waveform signal 232. The external high voltage waveform signal 232, as will be discussed subsequently with reference to FIGS. 5-6, may be used as a portion of the drive waveform for individual ones of the ejection elements 210. In another embodiment, the high voltage output circuit 238 may be disposed in the printhead 300 rather than in the external waveform generator 230, with the arbitrary waveform signal communicated from the external waveform generator 230 to the printhead 300, rather than the external high voltage waveform signal 232.

The processor 220 further supplies a waveform control signal 229 to the external waveform generator 230. The waveform control signal 229 may start and stop generation of the external high voltage waveform signal 232 by the external waveform generator 230, synchronize generation of the external high voltage waveform signal 232 to generation of the nozzle drive waveforms 212 by the printhead IC 300, and perform other functions. For example, if the data 228 represents several different waveforms, or several different pulses of a waveform, the waveform control signal 229 may also indicate which of these waveforms or pulses will comprise the external high voltage waveform signal 232.

While FIG. 2 illustrates that one printhead IC 300 supplies all of the drive waveforms to one module (also known as a "jet pack") of ejection elements 210, alternate embodiments may have different configurations. For example, in some embodiments one printhead IC 300 may supply drive waveforms to multiple ejection element modules, while in other embodiments one printhead IC 300 may supply drive waveforms to a subset of the ejection elements of an ejection element module. Thus the number of ejection elements for which the printhead IC 300 provides drive waveforms is arbitrary. Also, the printhead IC 300 and other elements may be fabricated on the same substrate, and/or in the same die stack, as ejection elements 210, along with lines 212A,B,N. Alternatively, the printhead IC 300 may be fabricated on a different substrate from the ejection elements 210, and lines 212A,B,N may be subsequently wire bonded between the printhead IC 300 and the ejection elements 210. In addition, while FIG. 2 illustrates each line 212A,B,N as a single line, in other embodiments each line 212A,B,N may comprise a pair of lines, each of which provides the drive waveform in opposite polarity from the other.

Considering now one embodiment of a printhead IC 300 for generating the drive waveforms to the ejection elements 210, and with further reference to FIG. 3, the printhead IC 300 generates the drive waveforms for a number of ejection elements 210. The printhead IC 300 includes a number of drive circuits 310, each of which generates the drive waveform for a subset of the ejection elements 210. FIG. 3 illustrates two drive circuits 310A,B, in which drive circuit 310A generates nozzle drive waveforms 212A,B through 212I and drive circuit 310B generates nozzle drive waveforms 212J,K through 212N. Each one of the ejection elements 210 is associated with a single subset. In some embodiments, each drive circuit 310 generates the drive waveform for a single one of the ejection elements 210.

Control logic 320 receives register data 222 and nozzle data 224 from an external source, and provides register data 322 and nozzle data 324 to other components of the printhead IC 300. In providing data 322,324 to these components, the control logic may buffer the data 222,224; serialize or parallelize the data 222,224; convert the format of the data 222, 224; synchronize transmission of the data 222,224 with other clock or control signals of the printhead IC 300; and/or perform other operations. The control logic 320 also generates a nozzle clock signal 326 and a global count signal 328. These signals are used by the printhead IC 300 in generating the drive waveforms 212. The processor 220 may generate signals analogous to the nozzle clock signal 326 and the global count signal 328 in conjunction with generating waveform control signal 229. The nozzle clock signal 326 and the global count signal 328 will be discussed subsequently in greater detail with reference to FIG. 7.

The printhead IC 300 includes a set of global registers 330, and a set of local registers 340 within each corresponding drive circuit 310. The registers 330,340 collectively store parametric data that defines, in part, the various drive waveforms. The set of global registers 330 stores first parametric data that is associated with the drive waveforms of all of the ejection elements 210. Each set of local registers 340 stores second parametric data that is associated with the drive waveforms of the subset of ejection elements 210 that are associated with the corresponding drive circuit 310. For example, local registers 340A store second parametric data for drive waveforms 212A,B through 212I, and local registers 340B store second parametric data for drive waveforms 212J,K through 212N.

Figure 4:
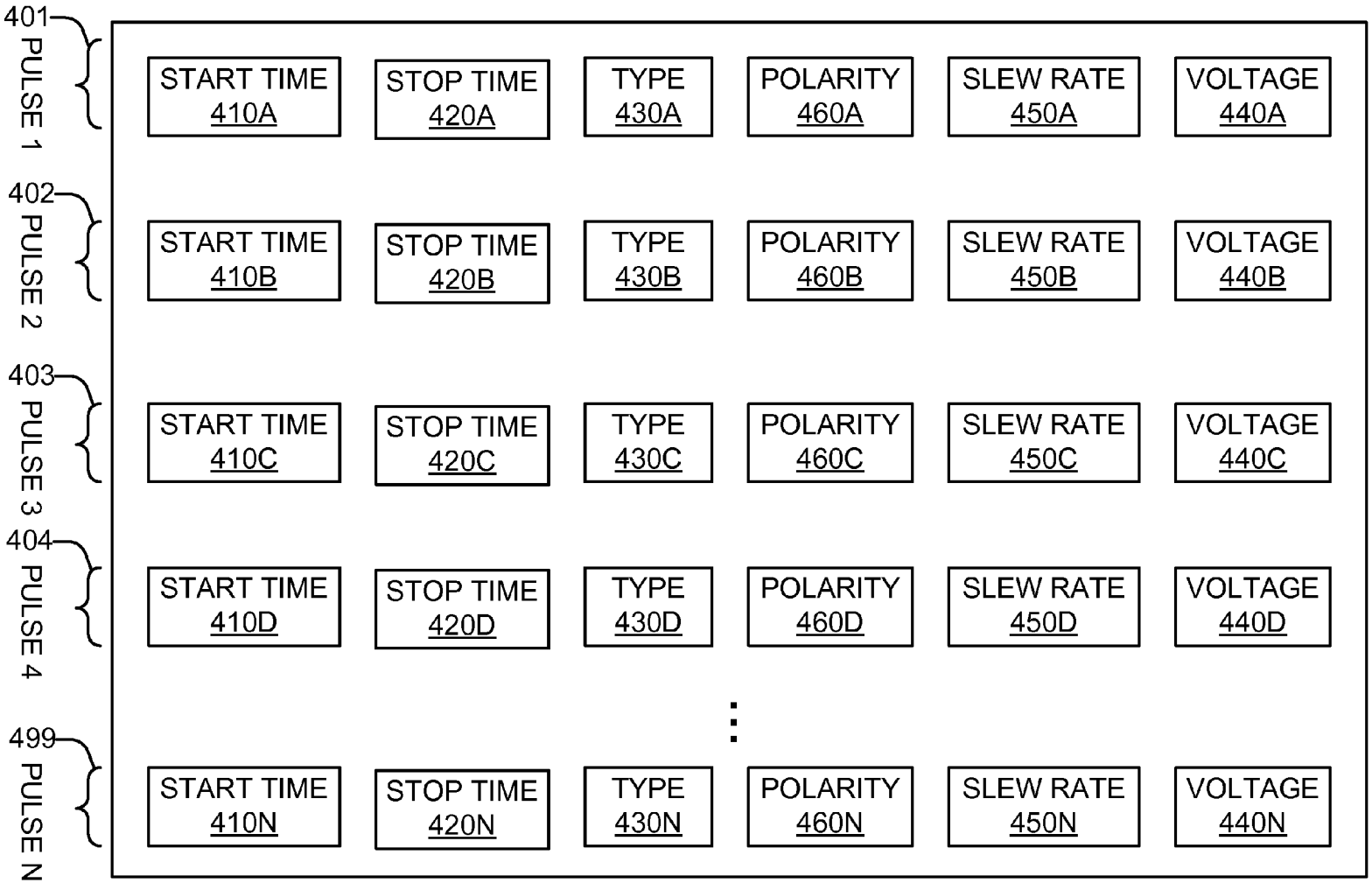
FIG. 4 is a schematic representation of an organization of data registers according to an embodiment of the present disclosure usable with the printhead IC of FIG. 3.
Figure 7:
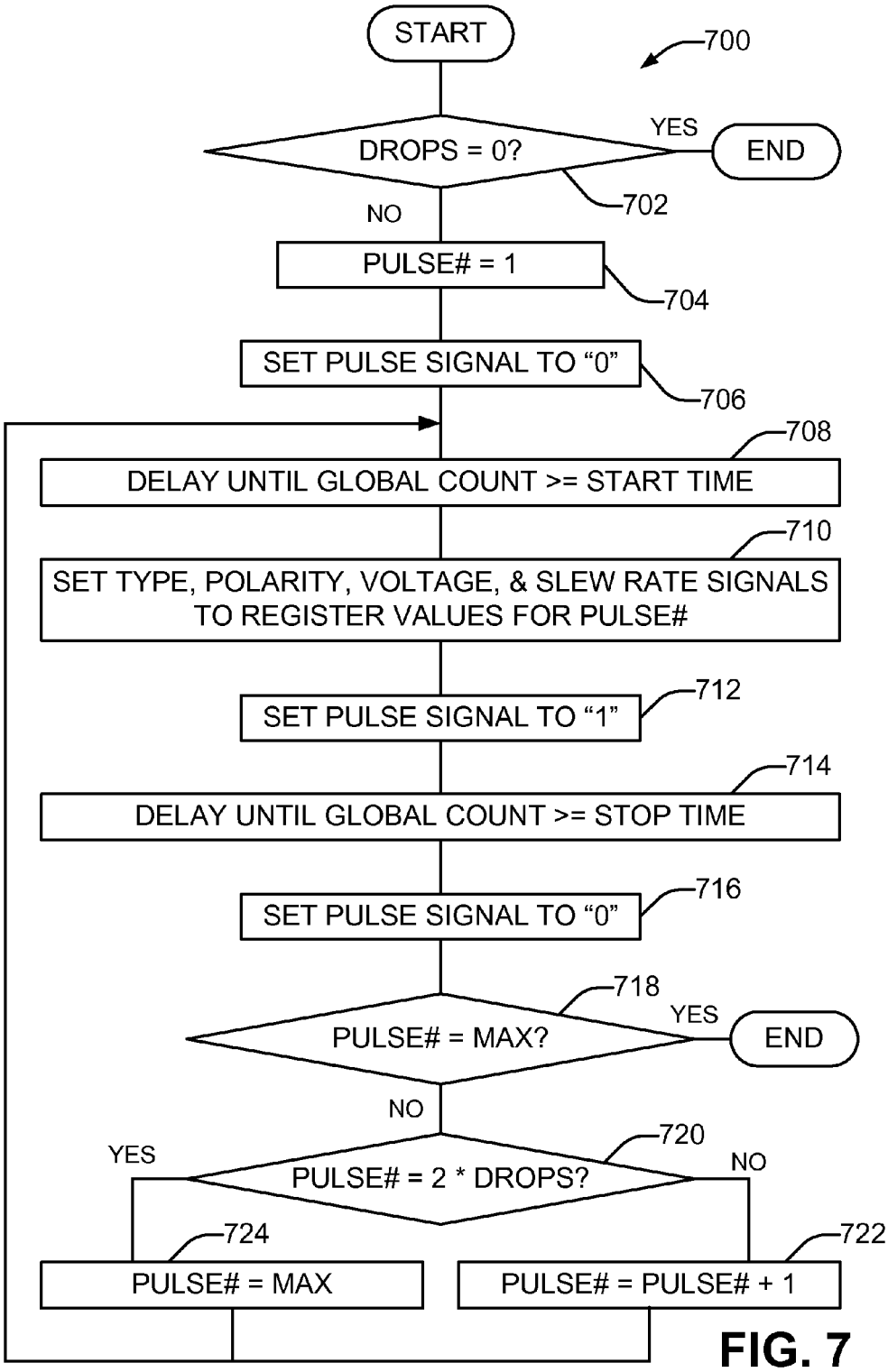
FIG. 7 is a flow diagram in accordance with an embodiment of the present disclosure of a method of operating a digital waveform generator of the drive circuit of FIG. 5.
Figure 8:
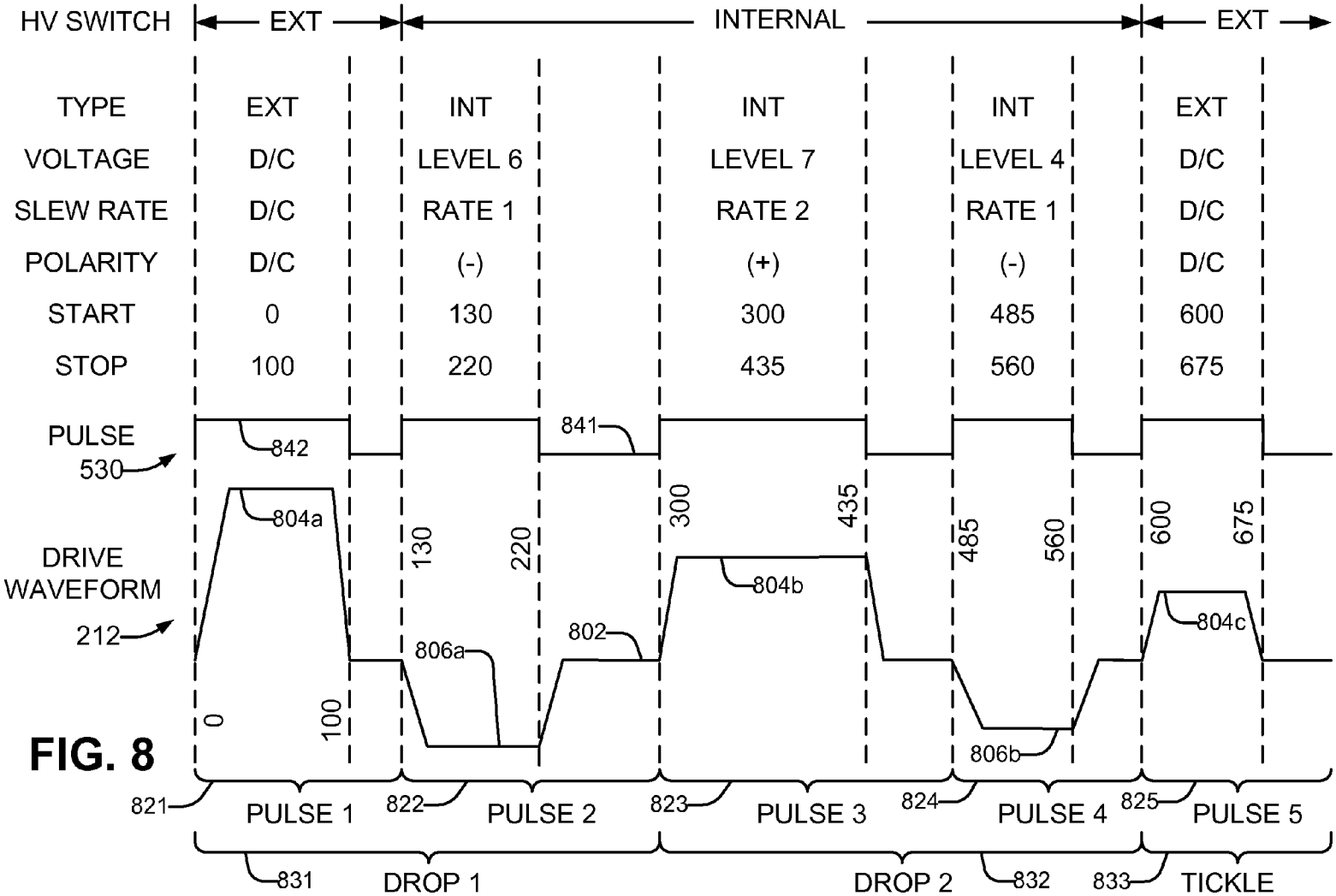
FIG. 8 is a schematic timing diagram illustrating the relationship between example register data, an example digital signal, and an example drive waveform generated by the printhead of FIG. 2 according to an embodiment of the present disclosure.

As can be understood with reference to FIG. 4, the global registers 330 and the local registers 340 of a drive circuit 310 collectively define parametric data for one or more pulses of a drive waveform 212 generated by the drive circuit 310. In one embodiment, the parametric data comprises individual data for different pulses 401-404,499. For each pulse 1 401 through N 499, the parametric data may comprise a pulse type 430 (i.e. generated internally by the printhead IC 300, or received from an external source such as external waveform generator 230), pulse start time 410, pulse stop time or duration 420, pulse voltage 440, pulse slew rate 450, and pulse polarity 460. Each drive circuit uses the parametric data in the global registers 330 and in its own local registers 340 to generate a pulse internally. The registers 330,340 define parametric data for the maximum number of pulses (i.e. N pulses) that may comprise a drive waveform. The maximum number of pulses, as will be discussed subsequently with reference to FIGS. 7-8, is related to the maximum number of drops of liquid that may be emitted for a particular pixel of the image printed, while the number of drops is in turn related to the number of different grayscale levels which can be specified by the nozzle data for an individual ejection element 210.

FIG. 4 illustrates the collective set of parametric data formed by first parametric data of the global registers 330 and the second parametric data of the local registers 340. In different embodiments, the parametric data may be divided between the global registers 330 and local registers 340 in a variety of ways. For example, the parametric data for pulse 1 401 may be stored in the global registers 330, and for pulse 2 402 in the local registers 340. Or, the parametric data for start time 410A-N may be stored in the global registers 330, and for stop time 420A-N in the local registers 340. Or, the parametric data for start time 410A of pulse 1 401 and stop time 420B of pulse 2 402 may be stored in the global registers 330, and the parametric data for start time 4108 of pulse 2 402 and stop time 420A of pulse 1 401 may be stored in the local registers 340. The partitioning of parametric data between the global registers 330 and local registers 340 may be a function of design tradeoffs involving cost, size, and performance of the printhead 200. The more parametric data that is assigned to the set of global registers 340, the smaller and less costly the printhead IC 300 can be made since the global registers for this parametric data are not replicated in each set of local registers. However, the more parametric data that is assigned to the set of global registers 340, the less the drive waveform can be customized for a particular subset of the ejection elements 210. If the drive waveform cannot be sufficiently customized to compensate for manufacturing and wear deviations among all the ejection elements, the printhead 200 may need to be rejected or replaced, thus increasing cost.

A similar relationship exists between the number of subsets of ejection elements 210 and the total number of ejection elements 210. The fewer the number of subsets, the fewer the number of drive circuits 310 and local registers 340, and the smaller and less costly the printhead IC 300 can be made. However, having a fewer number of drive circuits 310 in the printhead IC 300 results in more ejection elements 210 being assigned to at least some of the subsets. This increases the chance that at least one of the ejection elements 210 in the enlarged subset will be defective or deteriorate relative to the rest of the ejection elements 210 in the subset, adversely affecting the printed image quality since the defective element cannot be compensated differently from the other elements in the subset. If this occurs, the printhead 200 may need to be rejected or replaced, thus increasing cost. Thus in many applications it is advantageous to make each ejection element its own subset, even if some of the parametric data is stored in the global registers 330 rather than in a local register 340 specific to an individual ejection element. Such an approach allows each ejection element to be individually compensated or trimmed, at least to some degree, so that rejection or replacement of the printhead 200 can advantageously be avoided.

Figure 5:
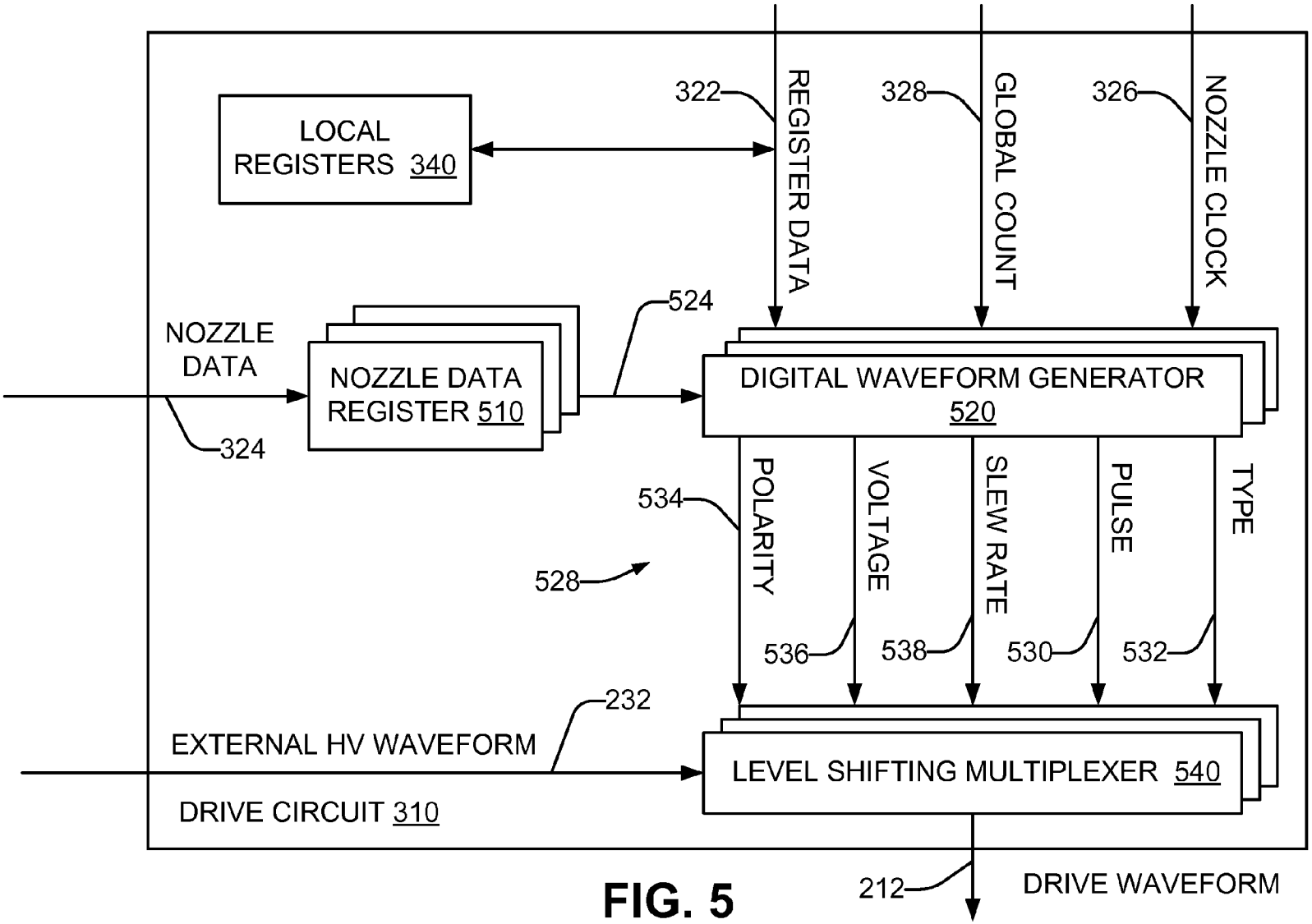
FIG. 5 is a schematic representation of a drive circuit according to an embodiment of the present disclosure usable with the printhead IC of FIG. 3.

Considering now one embodiment of a drive circuit 310 for generating the drive waveforms to the ejection elements 210, and with further reference to FIG. 5, each drive circuit 310 includes at least one nozzle data register 510. The drive circuit 310 includes a nozzle data register 510 for each separate drive waveform 212 generated by the drive circuit 310, which in turn corresponds to the number of ejection elements 210 in the subset of ejection elements corresponding to the drive circuit 310. In some embodiments, the nozzle data 324 may be binary data in which, for example, a logic 0 indicates that no drops of liquid are to be ejected from the corresponding ejection element 210, and a logic 1 indicates that one drop of liquid is to be ejected from the corresponding ejection element 210 for a particular pixel of the image being printed. In other embodiments, the nozzle data 324 may be multi-drop grayscale data. For example, three bits may be utilized to encode the grayscale data, which can specify that from zero to seven drops of liquid are to be ejected from the corresponding ejection element 210 for the particular pixel of the image being printed. The nozzle data register 510 stores the nozzle data 324 during the generation of the corresponding drive waveform 212.

The drive circuit 310 also includes a digital waveform generator 520 for each separate drive waveform 212 that is generated by the drive circuit 310. The number of digital waveform generators 520 in a particular drive circuit 310 equals the number of ejection elements 210 that are in the subset of ejection elements associated with that drive circuit 310. For example, if there are five ejection elements 210 in the subset of ejection elements associated with a particular drive circuit 310, there are five separate digital waveform generators 520 in the drive circuit 310. The digital waveform generator 520 receives the parametric data in the global registers 330, and the parametric data in the local registers 340 of the drive circuit 310. The digital waveform generator 520 generates a digital signal 528 for a level shifting multiplexer 540 in accordance with the parametric data in the global registers 330, the parametric data in the local registers 340 of the drive circuit 310, and the nozzle data 524 provided by the nozzle data register 510.

The drive circuit 310 also includes a level shifting multiplexer 540 for each separate drive waveform 212 that is generated by the drive circuit 310. The number of level shifting multiplexers 540 in a particular drive circuit 310 equals the number of digital waveform generators 520 in that circuit 310. The level shifting multiplexer 540 receives the digital signal 528 from the corresponding digital waveform generator 520 and generates a drive waveform 212 corresponding to the digital signal 528. The drive waveform 212 is generated in accordance with the parametric data in the global registers 330, the parametric data in the local registers 340 of the drive circuit 310, and the nozzle data 524 provided by the nozzle data register 510. The drive waveform 212 is then sent to a corresponding ejection element 210.

The digital signal 528, in one embodiment, includes a pulse 530, a type signal 532, a polarity signal 534, a voltage signal 536, and a slew rate signal 538. The digital signal 528 will be discussed subsequently in greater detail with reference to FIGS. 7-8.

Before considering the level shifting multiplexer in greater detail, it can be helpful to consider, and with reference to FIG. 8, an example drive waveform 212 for a piezo ejection element. The drive waveform 212 may be a bipolar voltage waveform. From a back-bias (or offset) voltage level 802, the waveform may transition to a higher voltage 804 or a lower voltage 806. In one embodiment, the back-bias voltage level 802 may be 40 volts, the higher voltage 804 may range as high as 60 volts, and the lower voltage 806 may range as low as 0 volts. As illustrated in FIG. 8, drive waveform 212 may have a variety of different higher and lower voltages such as, for example, higher voltages 804*a-c* and lower voltages 806*a-b*. When the back-bias voltage level is applied to an ejection element 210, no displacement or deformation of the piezo material occurs, while the higher voltage and lower voltage pulses cause displacement or deformation of the piezo material. Drops of liquid can be ejected from the ejection element 210 by applying a particular sequence of pulses consistent with predetermined parametric data that causes the displacement or deformation to occur in a particular manner. FIG. 8 illustrates an example drive waveform 212 that has 5 pulses 821-825. Applying positive pulse 1 821 followed by negative pulse 2 822 causes a first drop 831 to be ejected. Subsequent pulses 3 823 and 4 824 cause a second drop 832 to also be ejected. Other waveforms 212 may apply more or fewer pulses to cause more or fewer drops to be ejected, consistent with nozzle data 524. The timing, duration, voltage, and slew rate of the pulses, along with any residual energy in the ejection element 210 from a previous pulse or pulses, determines the drop weight, velocity, and direction of each ejected drop, at least in part. Typically, the parametric data for each pulse is specified such that the ejected drops of liquid merge in flight into a combined drop that contacts an intended location on the print medium. By varying the number of drops that merge into the combined drop, the size of the combined drop can be modulated to represent multiple levels of a grayscale nozzle data value.

Pulse 5 825 of the example drive waveform 212 is an anti-resonance damping pulse, also called a "tickle" pulse 833, that damps the energy in the chamber in preparation for the next drive waveform 212. The tickle pulse 833 is applied as the last pulse after all drop ejection pulses (e.g. pulse 1 821 through pulse 4 824 in FIG. 1) have been applied to the ejection element 210. In some embodiments, there may be a considerable delay after the last drop ejection pulse and before the tickle pulse 833, with the drive waveform 212 remaining at the back-bias voltage level 802 in the interim. In some embodiments, the tickle pulse may be applied at a time that is independent of the nozzle data 524. For example, if a single drop 831 is to be ejected from a particular ejection element 210, the tickle pulse 833 may still be generated at the time indicated in FIG. 8, with the drive waveform 212 remaining at the back-bias voltage level 802 during the time corresponding to the second drop 832. In some embodiments, the tickle pulse may be generated at the same time for a number of ejection elements 210.

Figure 6:
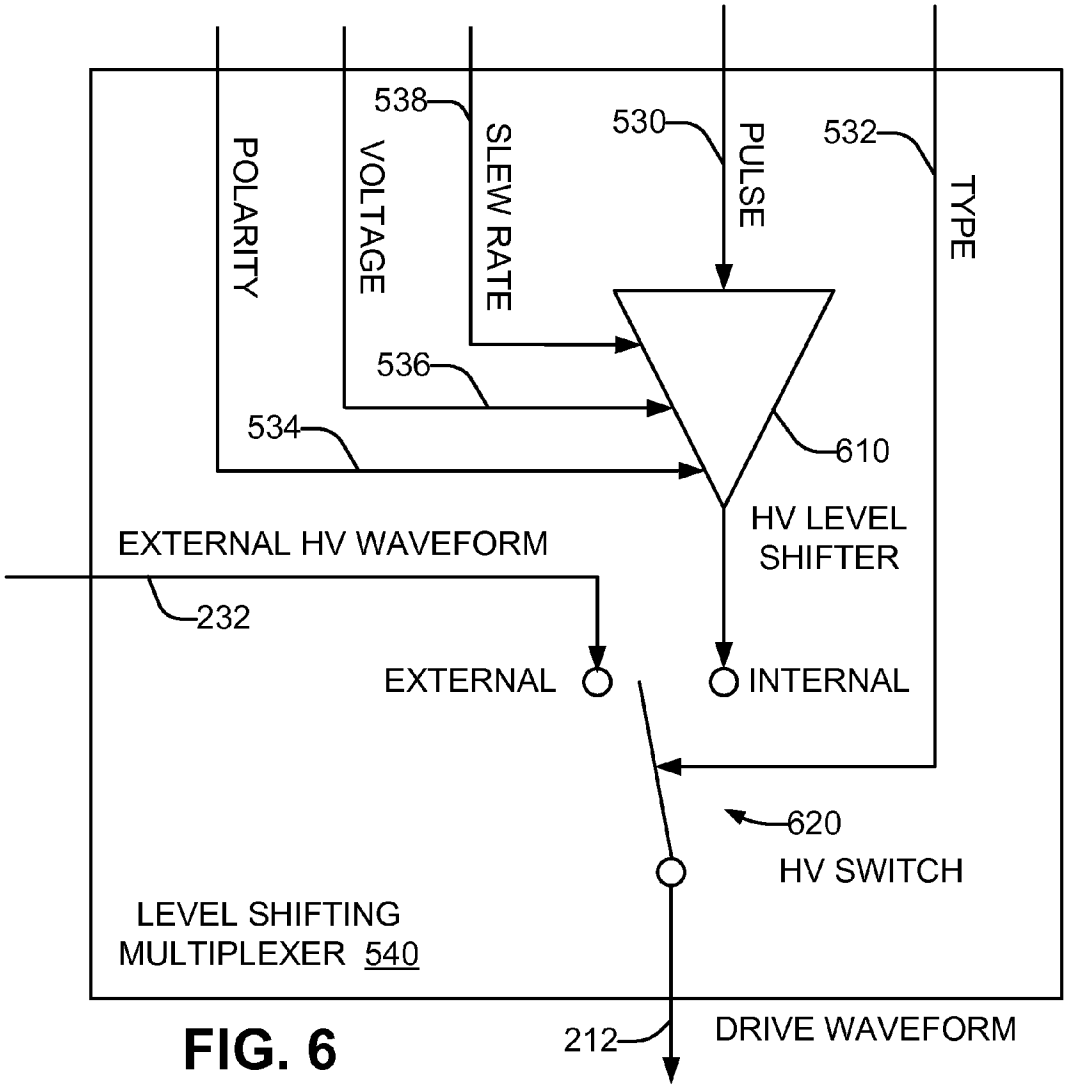
FIG. 6 is a schematic representation of a level shifting multiplexer according to an embodiment of the present disclosure usable with the drive circuit of FIG. 5.

Considering now one embodiment of a level shifting multiplexer 540 for generating the drive waveforms to the ejection elements 210, and with further reference to FIGS. 6 and 8, the level shifting multiplexer 540 receives the digital signal 528 generated by the corresponding digital waveform generator 520. The digital signal 528 defines the drive waveform 212 generated by the level shifting multiplexer 540. The drive waveform 212 may be generated internally from the digital signal 528 by a high voltage level shifter 610. The high voltage level shifter 610 uses the polarity signal 534, voltage signal 536, and slew rate signal 538 to convert the binary pulse signal 530 into a bipolar drive waveform. The combination of the digital waveform generator 520 and high voltage level shifter 610 do not constitute an arbitrary waveform generator. Rather, certain aspects of the generated drive waveform can be controlled in a limited manner that is sufficient to trim or compensate a particular ejection element so as to operate substantially similarly to other ejection elements. The polarity signal 534 is typically a 1-bit signal that specifies whether the high voltage level shifter 540 produces a positive (+) voltage pulse or a negative (−) voltage pulse in response to the pulse signal from the digital waveform generator 520. The voltage signal 536 may be a multi-bit signal that specifies a number of levels of adjustment to a nominal voltage level. For example, if the nominal voltage level for a positive voltage pulse is 60 volts, 3 bits may define 7 additional discrete levels, providing a selectable range of 55 to 60 volts in 0.5 volt steps. The slew rate signal 538 may be a multi-bit signal that specifies a number of different slew rates that define the transition time for the change of voltage from one level to another level. For example, 2 bits may be used to select a slew rate of 60 volts/microsecond, 80 volts/microsecond, 100 volts/microsecond, or 120 volts/microsecond. In some embodiments, different slew rates may be defined for the leading edge and the trailing edge of a pulse. While the example slew rates are linear, non-linear slew rates may also be specified and utilized. The pulse signal 530 from the digital waveform generator 520 defines a pulse by providing a logic 1 for a time that corresponds to the pulse duration. During the time that the pulse signal is at the logic 1 level, the high voltage level shifter 610 produces a voltage output corresponding to the values of the voltage, slew rate, and polarity signals. When the pulse signal returns to the logic 0 level, the high voltage level shifter 610 outputs the back-bias or output voltage level.

The voltage output of the high voltage level shifter 610 is provided to one input terminal of a high voltage switch 620 that is configured logically as a single-pole, double-throw switch. The other input terminal may be connected to an external high voltage waveform, such as external high voltage waveform 232. Which of the two input terminals is selected to provide the drive waveform 212 by the high voltage switch 620 at any point in time is determined by the state of the 1-bit type signal 532. In this way, the high voltage switch 620 may controllably apply either the external high voltage waveform or the internal high voltage waveform generated by the high voltage level shifter 610 at different times. This allows one portion of the drive waveform 212 to be the external high voltage waveform and another portion of the drive waveform 212 to be the internal high voltage waveform. It alternatively allows the entire drive waveform 212 to be the external or internal waveform.

Considering now in greater detail the operation of one embodiment of the digital waveform generator 520, and with reference to FIGS. 5 and 7, the digital waveform generator 520 may include a processing element that implements a method 700 for generating the digital signal 528 for the level shifting multiplexer 540 in accordance with the parametric data in the global registers 330, the parametric data in the local registers 340 of the drive circuit 310, and the nozzle data 524 provided by the nozzle data register 510. The processing element may comprise an algorithmic state machine implemented in hardware. Alternatively, the processing element may comprise a microprocessor or a microcontroller utilizing firmware or microcode stored in a memory. The method 700 begins at 702 by comparing to zero the number of drops of liquid to be ejected by the ejection element 210, as specified by the corresponding nozzle data 524. If the comparison is true ("Yes" branch of 702), the method terminates and no drops are ejected. If the comparison is false ("No" branch of 702), then at 704 a "Pulse#" counter is set to 1. At 706, the pulse signal 530 is set to logic 0. At 708, the method delays until the global count 328 equals or exceeds the value in the start time 410 register (located in global registers 330 or local registers 340) for the pulse number which corresponds to the current value of the Pulse# counter. For example, if the Pulse# counter equals 3, start time register 410C would be utilized. In some embodiments, the global count 328 may be sampled and compared on an edge of the nozzle clock 326. Once the global count 328 equals or exceeds the start time 410, then at 710 the type signal 532, polarity signal 534, voltage signal 536, and slew rate signal 538 are set to the respective values specified in the global registers 330 or local registers 340 for the pulse number which corresponds to the current value of the Pulse# counter. For example, when the Pulse# counter equals 3, the voltage signal 536 is set to the value in the voltage 440C register, the slew rate signal 538 is set to the value in the slew rate 450C register, etc. Once the signals 532-538 have settled, the pulse signal 530 is set to logic 1 at 712, and the high voltage level shifter 610 begins generating the pulse. At 714, the method delays until the global count 328 equals or exceeds the value in the stop time 412 register for the pulse number which corresponds to the current value of the Pulse# counter. At 716, the pulse signal 530 is set to logic 0, and the high voltage level shifter 610 terminates generation of the pulse. At 718, the Pulse# counter is compared to the maximum pulse number, which corresponds to the tickle pulse that concludes the drive waveform 212. For example, the register organization of FIG. 4 illustrates that the pulses range from pulse 1 401 to pulse N 499, and thus the Pulse# counter is compared to the value N, since the registers 410N-460N for pulse N define the parameters of the tickle pulse. If the comparison is true ("Yes" branch of 718), then all pulses, including the tickle pulse, have been generated and the method concludes. For example, FIG. 8 illustrates that the final pulse, pulse 5 825, is the tickle pulse. If the comparison is false ("No" branch of 718), then the Pulse# counter is next compared to the value of 2 times the number of drops of liquid to be ejected by the ejection element 210, as specified by the corresponding nozzle data 524. Multiplying by 2 accounts for each drop being generated by a sequence of two pulses; for example, FIG. 8 illustrates that drop 2 832 results from the application of pulse 3 823 and pulse 4 824. If the comparison is false ("No" branch of 720), then the Pulse# counter is incremented and the method continues at 708 to generate the next pulse. If the comparison is true ("Yes" branch of 720), then the Pulse# counter is set to the maximum pulse number N since the desired number of drops have all been ejected, and all that remains to be generated for the drive waveform 212 is the tickle pulse 833. The method continues at 708 to generate the tickle pulse 833.

Considering now in greater detail, and with reference to FIGS. 4, 7, and 8, the example drive waveform 212 for a piezo ejection element, the waveform 212 is generated by the level shifting multiplexer 540 from the digital signal 528 provided to the level shifting multiplexer 540 by the digital waveform generator 520. The vertical axes illustrated in dashed form in FIG. 8 correspond to specific values of the global count 328, as indicated. The global count starts from 0, increments at a fixed interval, and can be reset to 0. Beginning from the left side of FIG. 8, the vertical axes represent global count values of 0, 100, 130, 220, 300, 435, 485, 560, 600, and 675. In one embodiment, the nozzle clock 326 may be a 30 MHz clock with each clock pulse having a period of approximately 33 nanoseconds, the global count may be a 16-bit number which supports count values ranging from 0 to 65,535, and the count interval is 33 nanoseconds. For a drive waveform 212 in which an individual drop of liquid, for example one of drops 831-832, is ejected from an ejection element in 10 microseconds, the global counter spans an interval of 300 counts during the drop ejection.

The generation of pulse 3 823 will now be considered. The values 403 of the parametric data associated with pulse 3 823 are illustrated on FIG. 8 above the pulse. For example, type register 430C has a value of "Internal", voltage register 440C has a value of "Level 7", slew rate register 450C has a value of "Rate 2", polarity register 460C has a value of "(+)", start time register 410C has a value of 300 counts, and stop time register 420C has a value of 435 counts. Note that while stop time register 420C has been illustrated as an absolute count, it can alternatively represent a count relative to the start time that represents the duration of the pulse; in this case, the duration would be 135 counts. During generation of the drive waveform 212, the drive waveform generator 520 operates as has been previously described with reference to FIG. 7. FIG. 8 also illustrates the pulse signal 530 generated by the drive waveform generator 520. When the value of the global count 328 reaches 300, the drive waveform generator 520 sets the pulse signal 530 to logic "1" 842 while it also applies a type signal 532 of "Internal", a voltage signal 536 of "Level 7", a slew rate signal 538 of "Rate 2", and a polarity signal 534 of "(+)". In response, the level shifting multiplexer 540 generates pulse 3 823. When the value of the global count 328 reaches 435, the drive waveform generator 520 sets the pulse signal 530 to logic "0" 841, and the voltage of the drive waveform returns to the back-bias level 802. The transitions between drive waveform 212 voltage levels when the type signal 532 is "Internal" are thus triggered by changes in the pulse signal 530, and are governed according to the voltage 536, slew rate 538, and polarity signals 534.

The generation of pulse 1 821 will now be considered. The values 403 of the parametric data associated with pulse 1 821 are illustrated on FIG. 8 above the pulse. Type register 430A has a value of "External". Consequently, the values of voltage register 440C, slew rate register 450C, and polarity register 460C are all "don't care", since the portion of the drive waveform 212 corresponding to pulse 1 821 is provided to the level shifting multiplexer 540 by the external waveform generator 230 as external HV waveform 232. The drive waveform 212, when the type signal 532 is "External" and the pulse signal 530 is at a logic "1" level 842, corresponds to the external HV waveform 232. In some embodiments, as illustrated in FIG. 8, the external HV waveform 232 may continue to be applied as the drive waveform 212 until the next pulse signal 530 with type signal 532 set to "Internal" is received; in such cases the external HV waveform 232 will apply the back-bias level 802 during the time when the pulse signal 530 is at a logic "0" level 841. In some embodiments, the external waveform generator 230 may be capable of generating a more complex waveform than the digital waveform generator 520 and level shifting multiplexer 540.

The generation of the other internal and external pulses of FIG. 8 is performed in a similar manner.

Figure 9:
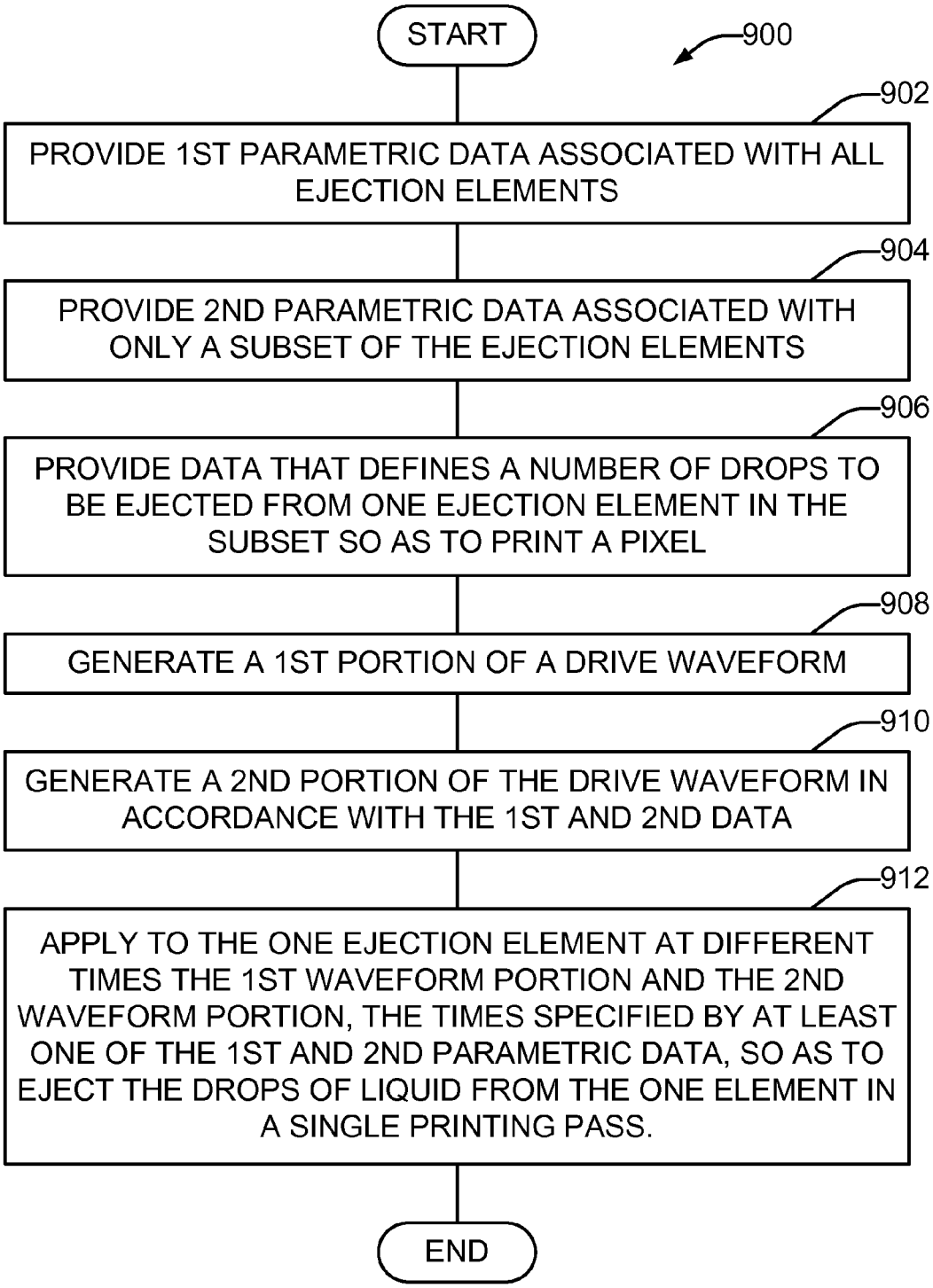
FIG. 9 is a flow diagram in accordance with an embodiment of the present disclosure of a method of generating a drive waveform to eject liquid from ejection elements in single-pass printing.

Considering now an embodiment of a method of generating a drive waveform 212 to eject liquid from ejection elements 210 in single-pass printing, and with reference to FIG. 9, a method 900 begins at 902 by providing first parametric data associated with all ejection elements 210. At 904, second parametric data associated with only a subset of the ejection elements is provided. At 906, data that defines a number of drops to be ejected from one ejection element 210 in the subset so as to print a pixel is provided. At 908, a first portion of the drive waveform 212 is generated. At 910, a second portion of the drive waveform is generated in accordance with the first and second data. At 912, the first waveform portion and the second waveform portion are applied to the one ejection element 210 at different times. The times are specified by at least one of the first and second parametric data, so as to eject the drops of liquid from the one element 210 in a single printing pass. In some embodiments, the first portion may correspond to a first pulse and the second portion to a second pulse of the drive waveform 212.

In some embodiments, the first and second parametric data cause the one ejection element 210 to emit drops having substantially the same drop weight, velocity, and direction as at least some others of the ejection elements 210. In this manner, at least some of the individual ejection elements 210 of the printhead 200 may be compensated or trimmed in order to achieve high quality print output by depositing drops of liquid of the desired size on intended locations of the print medium to form the print output. For example, to compensate for a defect in a particular ejection element 210 that produces drops with smaller drop weights, the voltage 440 value in the local registers 340 for the particular ejection element 210 may be increased to eject more liquid in the drop. As another example, at least one of the start time 410 and stop time 420 in the local registers 340 for the particular ejection element 210 may be adjusted to produce a longer duration for the pulse signal 530 that can increase its velocity and thus compensate for a failure of the drops to merge in flight. Or, to compensate for a misdirection of a drop, the start time 410 and stop time 420 in the local registers 340 for the particular ejection element 210 may be adjusted to shift the time at which the drop is generated.

In some other embodiments, the first and second parametric data cause the one ejection element to emit drops having a different drop weight, velocity, or direction from at least some others of the ejection elements. One example application for this type of operation is microprinting a portion of the printed output at an enhanced resolution, while other portions of the printed output are printed at a standard resolution, all in a single pass. For example, the signature line of a check is typically formed from microprinted text characters, while some other portions of the check are printed at standard resolution. The parametric data in the local registers 340 for those ejection elements 210 of the printhead 200 that microprint the text can be adjusted so as to produce much smaller drops than those ejection elements 210 which print in standard resolution. In addition, parametric data may be chosen that cause these smaller drops to not merge in flight, as they do in standard resolution printing. As a result, each individual smaller drop from the one ejection element 210 lands on a different location of the media, thus effectively increasing the printing resolution. For example, if standard resolution printing deposits a maximum of two drops that merge in flight to print at a resolution of 1200 dots per inch, microprinting with each of the two drops directed to different locations on the print medium effectively prints at double the resolution, 2400 dots per inch.

From the foregoing it will be appreciated that the drive waveform generator, printhead, and methods provided by the present disclosure represent a significant advance in the art. Although several specific embodiments have been described and illustrated, the disclosure is not limited to the specific methods, forms, or arrangements of parts so described and illustrated. This description should be understood to include all novel and non-obvious combinations of elements described herein, and claims may be presented in this or a later application to any novel and non-obvious combination of these elements. The foregoing embodiments are illustrative. Unless otherwise specified, steps of a method claim need not be performed in the order specified. Terms of orientation and relative position (such as "top," "bottom," "side," and the like) are not intended to require a particular orientation of any element or assembly, and are used for convenience of illustration and description. The disclosure is not limited to the above-described implementations, but instead is defined by the appended claims in light of their full scope of equivalents. Where the claims recite "a" or "a first" element of the equivalent thereof, such claims should be understood to include incorporation of one or more such elements, neither requiring nor excluding two or more such elements.

What is claimed is:

1. A drive waveform generator to control ejection of liquid from a set of ejection elements in single-pass printing, comprising:

a first waveform source to define a first aspect of a drive waveform for the set of ejection elements and for other ejection elements;

a second waveform source to define a second aspect of the drive waveform for the set of ejection elements but not for the other ejection elements; and a circuit that uses the first waveform source and the second waveform source to generate the drive waveform having the first and second aspects.

2. The waveform generator of claim 1, wherein the circuit generates the drive waveform in accordance with multi-level grayscale nozzle data for a particular one of the set of ejection elements, the nozzle data defining a number of pulses that comprise the drive waveform.

3. The waveform generator of claim 1, wherein:

the first and second aspects respectively comprise first and second portions of the drive waveform, the first waveform source comprises a first waveform circuit to generate the first portion of the drive waveform, the second waveform source comprises a second waveform circuit to generate the second portion of the drive waveform, and the circuit comprises a switch to selectably apply the first portion or the second portion of the drive waveform to an individual one of the set of ejection elements.

4. The waveform generator of claim 1, wherein:

the first and second aspects respectively comprise first and second parameters of the drive waveform, the first waveform source comprises a global data register to define the first parameter of the drive waveform, the second waveform source comprises a local data register to define the second parameter of the drive waveform, and the circuit comprises:

a digital generator coupled to the global and local data registers to generate digital data corresponding to the first and second parameters, and a high voltage level shifter that receives the digital data and generates the drive waveform for an individual one of the set of ejection elements.

5. The waveform generator of claim 4, wherein the drive waveform comprises at least one pulse;

wherein the first parameter is one of pulse start time, pulse stop time, pulse duration, pulse type, pulse voltage, pulse slew rate, and pulse polarity; and wherein the second parameter is a different one of pulse start time, pulse stop time, pulse duration, pulse type, pulse level, pulse slew rate, and pulse polarity.

6. The waveform generator of claim 1, wherein the drive waveform comprises at least three different voltage levels.

7. The waveform generator of claim 1, wherein:

the set comprises a single ejection element, and the other ejection elements comprise all the ejection elements of the printhead other than the single ejection element.

8. The waveform generator of claim 1, wherein the circuit controllably applies the drive waveform to one of the set of ejection elements.

9. The waveform generator of claim 1, comprising at least one additional second waveform source, each additional second waveform source to define the second aspect of the drive waveform for a different set of the other ejection elements.

10. The drive waveform generator of claim 1, wherein a first ejection element of the set has different drop ejection characteristics from a second ejection element of the other ejection elements, and wherein the second aspect for the first ejection element differs from a second aspect for the second ejection element such that the first and second ejection elements emit drops having substantially the same drop weight, velocity, and direction.

11. A printhead for controllably ejecting liquid in single-pass printing, comprising:

ejection elements arranged in subsets, each element associated with a single subset;

a global register to store first parametric data associated with all of the ejection elements;

a plurality of drive circuits each exclusively coupled to one of the subsets, each circuit comprising a local register to store second parametric data associated with only the one of the subsets, a waveform generator coupled to the global and local registers to receive the first and second parametric data and generate a digital signal in accordance therewith, and a level shifter coupled to the waveform generator to receive the digital signal and generate a drive waveform in accordance with the first and second parametric data.

12. The printhead of claim 11, wherein the printhead further comprises a second waveform generator external to the plurality of drive circuits to generate a second waveform; and wherein each of the plurality of drive circuits further comprises a switch responsive to the digital signal to apply to one of the ejection elements of the corresponding subset the drive waveform or the second waveform.

13. The printhead of claim 11, wherein each subset comprises a single one of the ejection elements.

14. The printhead of claim 11, wherein the drive circuit generates the drive waveform, for a particular one of the ejection elements in the one of the subsets, in accordance with multi-level grayscale nozzle data for the particular ejection element that defines a number of drops of the liquid to which the drive waveform corresponds.

15. The printhead of claim 11, wherein a first ejection element of the one subset has different drop ejection characteristics from a second ejection element of another subset, and wherein the drive waveform for the second ejection element is generated using different second parametric data from the first ejection element so that the second ejection element and the first ejection element emit drops having substantially the same drop weight, velocity, and direction.

16. The printhead of claim 11, wherein the digital signal comprises a plurality of bits indicative of the type, start time, stop time or duration, voltage, slew rate, and polarity of at least one pulse of the drive waveform.

17. A method of generating a drive waveform to eject liquid from ejection elements in single-pass printing, comprising:

providing first parametric data associated with all of the ejection elements;

providing second parametric data associated with only a subset of the ejection elements;

providing data that defines a number of drops to be ejected from one ejection element in the subset for a pixel;

generating a first portion of a drive waveform;

generating a second portion of the drive waveform in accordance with the first and second data; and applying to the one element the first portion and the second portion at different times specified by at least one of the first and second data to eject the drops to print the pixel.

18. The method of claim 17, wherein the first and second parametric data cause the one ejection element to emit drops having substantially the same drop weight, velocity, and direction as at least some others of the ejection elements.

19. The method of claim 17, wherein the first and second parametric data cause the one ejection element to emit drops having a different drop weight, velocity, or direction from at least some others of the ejection elements.

20. The method of claim 17, wherein the subset comprises only the one ejection element.

* * * * *